United States Patent [19]

Lofink et al.

[11] 4,080,904

[45] Mar. 28, 1978

[54] RAILWAY CAR POSITIONING APPARATUS

[75] Inventors: Gerard V. Lofink, Coraopolis; Carl J. Vozniak, Pittsburgh, both of Pa.

[73] Assignee: Heyl & Patterson, Inc., Pittsburgh, Pa.

[21] Appl. No.: 708,856

[22] Filed: Jul. 28, 1976

[51] Int. Cl.[2] ..... B61B 13/12; B61K 7/20

[52] U.S. Cl. ..... 104/162; 104/252

[58] Field of Search ..... 104/249, 251, 252, 253, 104/257, 258, 154, 162; 188/33, 35, 36; 105/141, 90 R, 90 A; 254/35

[56] References Cited

U.S. PATENT DOCUMENTS

| | | | |
|---|---|---|---|
| 874,349 | 12/1907 | Richards | 104/252 |
| 1,850,446 | 3/1932 | Camerota | 104/252 |
| 2,496,916 | 2/1950 | Kershaw | 104/252 |
| 3,251,313 | 5/1966 | Nansel | 105/141 |
| 3,407,750 | 10/1968 | Rantz | 104/162 |
| 3,793,964 | 2/1974 | Cheek et al. | 104/162 |

FOREIGN PATENT DOCUMENTS

| | | | |
|---|---|---|---|
| 916,628 | 12/1946 | France | 188/36 |
| 2,260,044 | 9/1973 | Germany | 104/257 |
| 805,536 | 6/1956 | United Kingdom | 104/252 |
| 827,587 | 2/1970 | United Kingdom | 104/249 |

*Primary Examiner*—Drayton E. Hoffman
*Assistant Examiner*—Carl Rowold
*Attorney, Agent, or Firm*—Brown, Murray, Flick & Peckham

[57] ABSTRACT

A pair of laterally spaced wheel chocks are each normally connected in a gap in a railroad track rail, with each chock having a straight upper surface over which car wheels can roll in crossing the gap. Pivotally connected on a horizontal axis to each chock is the rear end of an arm, the front end of which is pivotally connected to a support. Means are provided for lifting the chocks after car wheels have rolled across them, whereby to cause the chocks to engage a pair of car wheels and move them forward on the track. The arms guide the upwardly-moving chocks in paths that result in there being substantially no sliding of the chocks against the wheels.

7 Claims, 7 Drawing Figures

RAILWAY CAR POSITIONING APPARATUS

A train or string of railway cars containing bulk material, such as coal, often includes rotary couplers connecting the cars together so that each car, in turn, can be rotated to dump its contents in a rotary dumper. The connected cars are moved forward into the car dumper one at a time by means of a car positioner that runs back and forth on a track beside the train for moving the train ahead periodically. One of the requirements is that the longitudinal strain on the rotary couplers of the car being dumped be held below a predetermined maximum. This makes it necessary that the cars next to the opposite ends of the car being dumped be very accurately located so that neither car can move during the dumping operation and strain the couplers. Therefore, it is the practice to place removable wheel stops or front chocks in front of some of the wheels of the cars at the entrance and exit of the rotary dumper and then place rear chocks behind the wheels, but the car positioner cannot be depended upon to position the cars accurately enough to ensure that their wheels will engage the front chocks. Consequently, either of the two cars in question, or both of them, may be able to move forward or backward a short distance along the track and thereby put more tension or compression on the rotary couplers connected to the dumping car between them than is allowed.

It is among the objects of this invention to provide railway car positioning apparatus, which will engage a pair of wheels of a car that has been moved into its nearly correct location and then will move the car forward a short distance further until two of its wheels engage front stops, which is mounted in and between the track rails, which produces practically no slippage against the engaged wheels, and which in one position serves as part of the track rails.

The preferred embodiment of the invention is illustrated in the accompanying drawings, in which FIG. 1 is a side view showing a railway car truck, indicated in dotted lines, held in place on a track by front and rear chocks;

Figure 1:
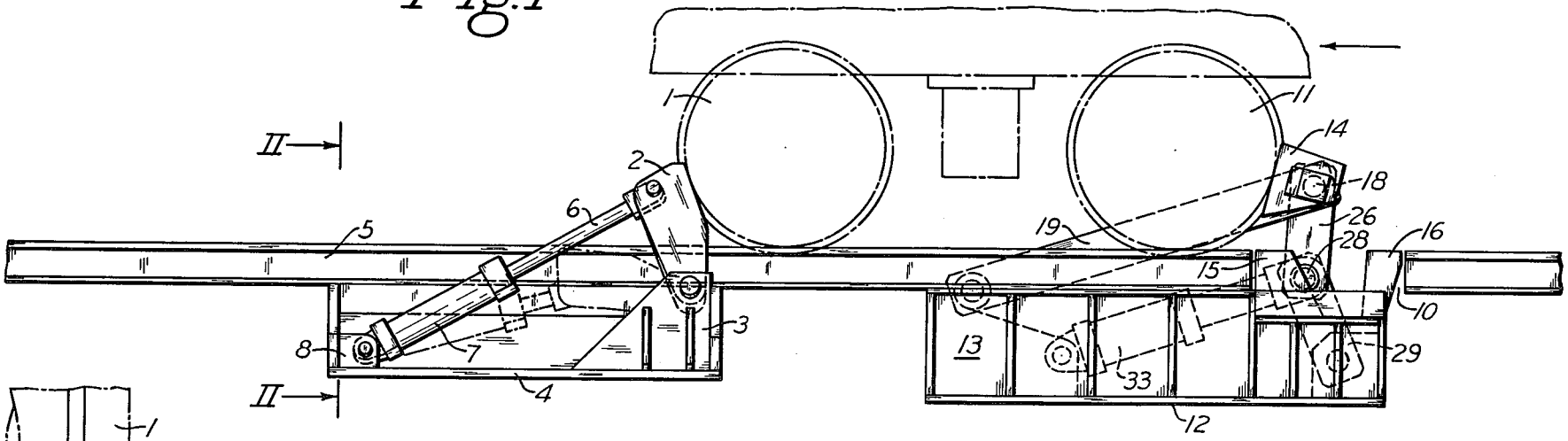
Figure 3:
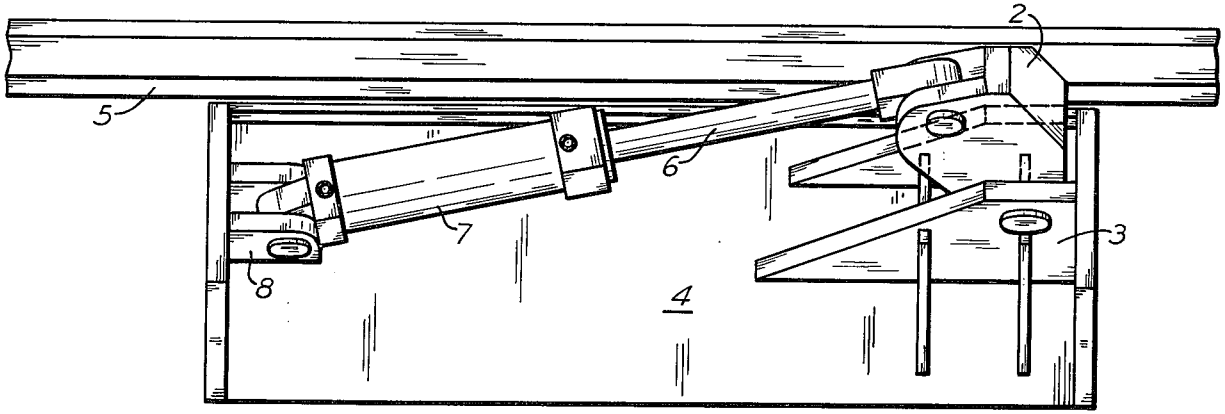
FIG. 3 is an enlarged plan view of the raised front stop.
Figure 2:
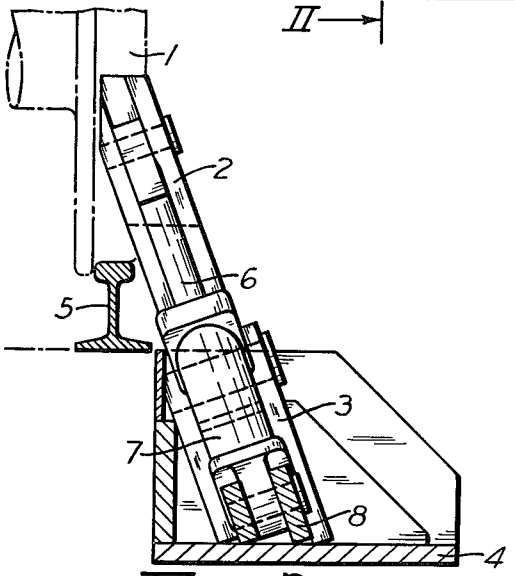
FIG. 2 is an enlarged end view of the front stop, taken on the line II—II of FIG. 1.

Referring to FIGS. 1, 2 and 3 of the drawings, retractable stops of any desired form are located in positions to be engaged by a pair of wheels 1 of a railway car to stop its forward movement in a predetermined location, such as at the entrance or exit of a rotary car dumper. Preferably, however, each stop includes a laterally inclined front chock 2 pivotally mounted at one end on a bracket 3 secured to a support 4 that is held firmly in place at the outside of the adjacent track rail 5. The upper end of the chock is provided with a slot that receives the rear end of a piston rod 6 pivotally connected to the chock. The rod extends forward into a fluid pressure cylinder 7, the front end of which is pivotally mounted in a bracket 8 secured to the support. In its normal position, the chock is swung down beside the rail where it will not interfere with cars moving along the track, but when it is desired to positon a car in a given location, fluid pressure is supplied to the front end of the cylinder to cause it to swing the chock up above the rail into a position where it can be engaged by a wheel of a forwardly-moving car and can arrest the wheel at that point.

Figure 4:
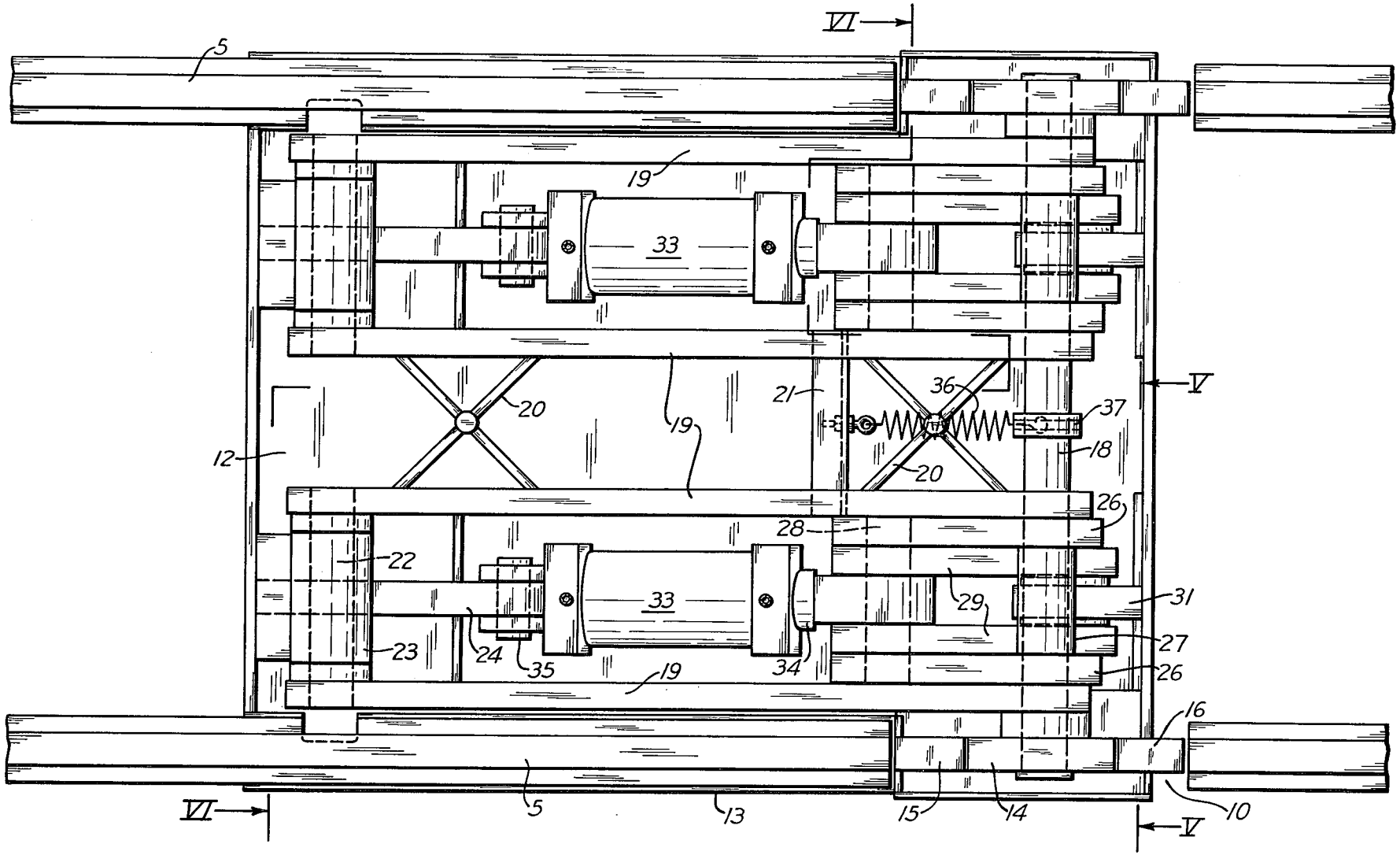
FIG. 4 is a plan view of the rear positioning apparatus.
Figure 5:
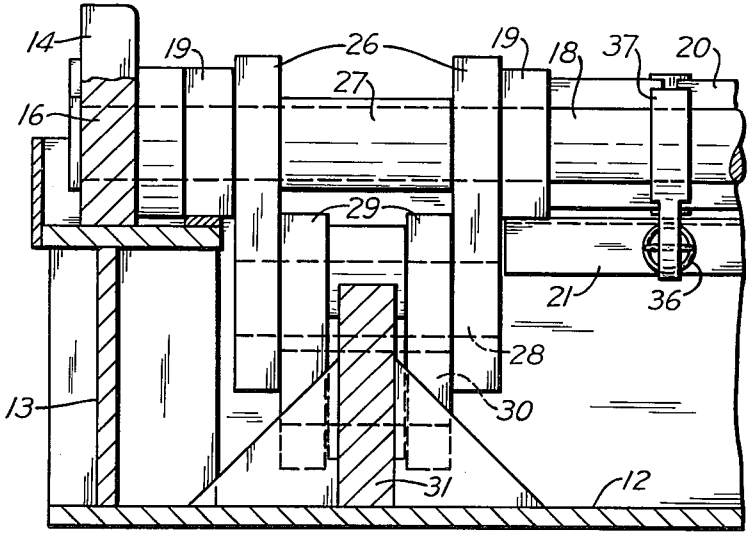
FIGS. 5 and 6 are enlarged vertical sections taken on the lines V—V and VI—VI, respectively, of FIG. 4.
Figure 6:
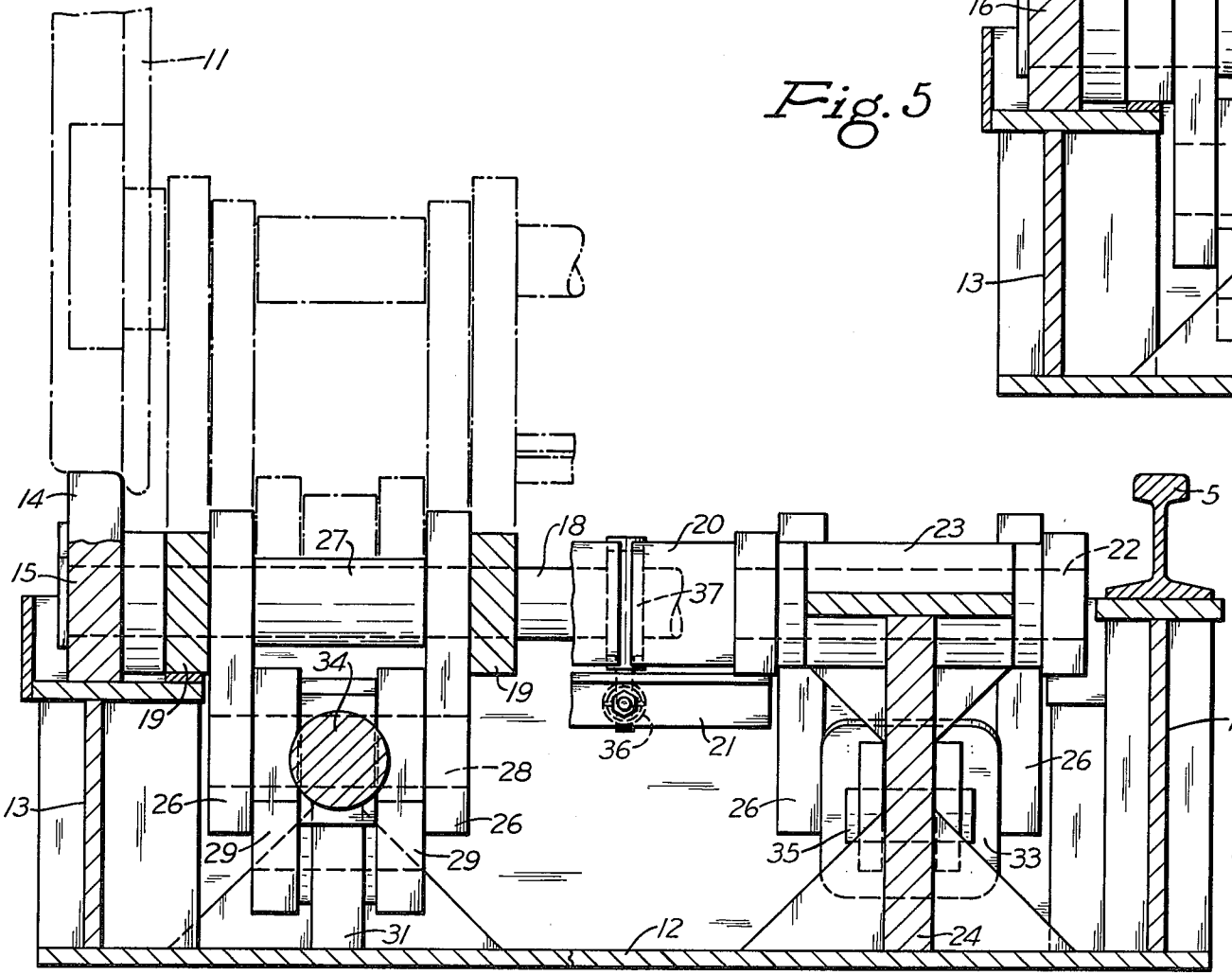
Figure 7:
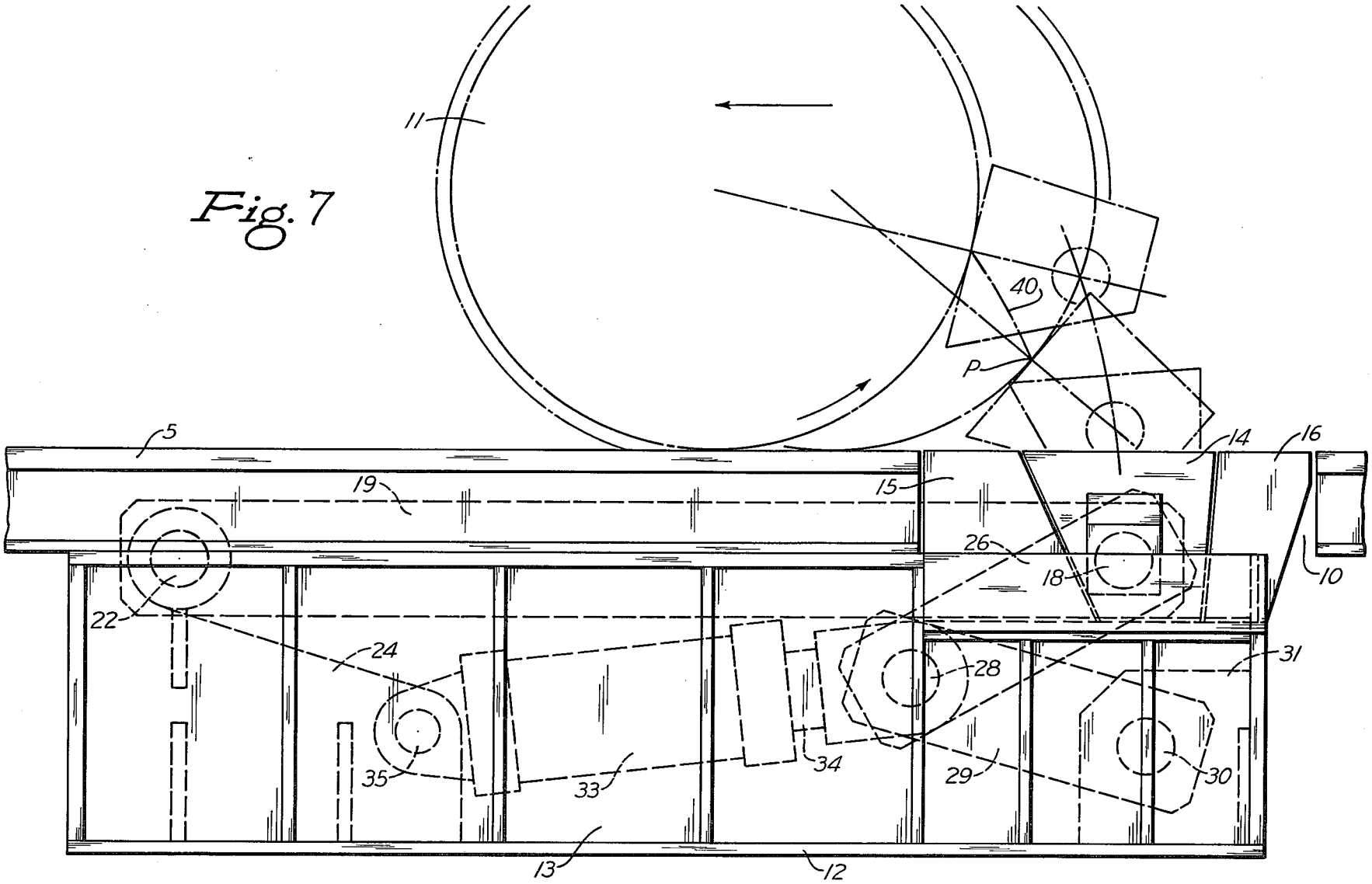
FIG. 7 is an enlarged side view of the rear positioning apparatus showing a chock in its lower position, with three other positions indicated in dotted lines.

A few feet behind these front stops, each track rail is provided with a gap 10 that will be close behind the rear wheels 11 of the car truck when its front wheels engage the front stops. Rigidly mounted on a solid bed between the rails is a heavy metal plate 12, the opposite sides of which extend beneath the rails. Mounted on this plate beneath the rails in front of gaps 10 are beams 13, on which the rails are rigidly mounted, as shown in FIGS. 1, 4 and 6. The height of these beams is reduced where they cross the gaps in the rails. Resting on the beam in the central part of each gap is a rear chock 14 that has a flat upper surface and, preferably, a nearly vertical rear surface and a front surface sloping from the top of the chock downwardly and rearwardly to the flat bottom of the chock as shown in FIG. 7. The upper surface is at the same level as the top of the adjacent rails. The spaces between the chock and the rails in front and behind it are filled by heavy metal blocks 15 and 16 rigidly mounted on the beam and likewise having flat upper surfaces aligned with the upper surface of the rails and chocks. It is a feature of this invention that these blocks and the chock between them normally form a continuation of the track across gap 10 so that car wheels can roll across the gap without difficulty while the chock is in its lower position supported by beam 13.

Between the rails there is a horizontal shaft 18, opposite ends of which are keyed in the rear chocks. This shaft is rotatably mounted in the rear ends of arms 19 that normally extend forward more or less horizontally, as shown in FIG. 7. Preferably, as shown in FIG. 4, there are four of these arms, arranged in two pairs with the two inner arms rigidly connected by diagonal braces 20 and a cross brace 21. The front ends of each pair of arms are rigidly mounted on the ends of a pivot pin 22 journaled in a bearing 23 welded to the top of a vertical plate 24 mounted on base plate 12. When the rear ends of the arms are raised, they will swing the chocks upwardly and forward.

There are different ways of lifting the arms and chocks, such as by screws or jacks, but preferably it is done by means of toggles, which may be operated by fluid pressure cylinders. Each toggle has a pair of upper links 26 pivotally mounted at one end on shaft 18 between a pair of the arms 19 and spaced apart by a sleeve 27 on the shaft. These links normally extend forward from the shaft as shown in FIG. 7, with their front ends rigidly mounted on the ends of a pivot pin 28. Pivotally mounted on this pin between the upper links are the front ends of a pair of lower links 29 that extend rearwardly and have their rear ends rigidly mounted on a pivot pin 30 journaled in a vertical bearing plate 31 mounted on the base plate below shaft 18.

If hydraulic cylinders are used for straightening and breaking the toggles, such a cylinder 33 is disposed in front of each toggle, with its piston rod 34 journaled on the central pivot pin 28 of the toggle between the lower links. The front end of the cylinder is pivotally mounted on a horizontal pin 35 extending through the forward vertical plate 24. When fluid under pressure is delivered to the rear ends of cylinders 33, their piston rods are moved rearwardly to straighten the toggles and thereby swing the arms and chocks upwardly together.

To maintain the upper surface of the rear chocks in the same position relative to arms 18 until the chocks engage the rear car wheels, and to return the chocks to that position when they leave the wheels, the rear end of a coil spring 36 (FIG. 4) is attached to a collar 37 rigidly mounted on the central portion of horizontal shaft 18. The rear end of the spring is rigidly connected to the cross brace 21 connecting the inner arms.

After a car positioner has caused the rear wheels 11 of the car truck to roll forward across the rear chocks in the gaps 10 in the rails, the hydraulic cylinders 33 are energized to cause the toggles to straighten and lift the chocks out of the gaps and into engagement with the rear wheels. As shown in FIG. 7, the front tip of each chock engages the wheel first and then the upper surface of the chock will roll forward against the wheel until a point on that surface is reached that is closest to the axis of shaft 18. That point is called the contact point herein. The upper surface of the chock also is tangent to the wheel at that point. As the chocks continue to be moved upwardly by the toggles they also are compelled by arms 19 to move forward to some extent and thereby force the wheels to roll forward far enough for the front wheels of the truck to engage the raised front chocks 2. By locking the fluid in the cylinders, the wheels are held firmly between the front and rear chocks, as shown in FIG. 1.

A special feature of this invention is that there is no, or substantially no, slippage between the rear chocks and wheels as those chocks roll the wheels forward. This highly desirable result, which reduces or eliminates wear of the chocks is accomplished as illustrated in FIG. 7. Any point on the circumference of a wheel rolling forward travels along or describes a cycloid curve. Such a curve 40 is indicated in FIG. 7. It is the path of point P on the dotted-line curve as the wheel rolls forward to its full-line position. Point P also is shown as being the point on the wheel engaged by the contact point on the upper surface of the rear chock. It will be seen that if that contact point is made to follow curve 40, there will be no slippage of the chock and wheel against each other. To accomplish this, the length of arm 19 and the location of pivot pin 22 must be such that shaft 18 will have to rise in an arc that will cause the contact point on the chock to follow the desired cycloid curve 40 while in engagement with the wheel at point P. Once this concept has been appreciated, it is a relatively simple matter to plot the arc in which shaft 18 should move, and that will determine the proper location for pivot pin 22 and the length of arm 19.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. Positioning apparatus for moving railway cars a short distance forward along track rails away from gaps in the rails, comprising a pair of laterally spaced wheel chocks each normally supported in a rail gap and having a straight upper surface over which car wheels can roll in crossing the gap, an arm pivotally connected on a horizontal axis to each chock and extending forward therefrom, means pivotally supporting the front ends of the arms on a horizontal axis, and lifting means for moving the chocks and rear ends of said arms upwardly to raise the chocks bodily out of said rail gaps and above the level of said last-mentioned horizontal axis, whereby the arms will swing the chocks forward to move car wheels engaged by them forward on the track.

2. Positioning apparatus according to claim 1, in which substantially all of said apparatus except said chocks is disposed between said track rails.

3. Positioning apparatus according to claim 1, in which said lifting means include a toggle pivotally connected at its upper end to each chock on the same axis as the adjoining arm, means pivotally supporting the lower end of the toggle, the toggle being formed from a pair of links normally extending lengthwise of said rails from said upper and lower ends with their other ends pivotally connected together, and means connected to said other ends of the links for straightening the toggle.

4. Positioning apparatus according to claim 3, including a pair of said arms for each chock, the toggle for each chock being disposed between the arms for that chock, and said toggle-straightening means being fluid pressure cylinders disposed between the arms of each pair of arms.

5. Positioning apparatus according to claim 1, including spring means for maintaining the upper surfaces of said chocks in the same position relative to said arms until the pressure of the front ends of the upwardly moving chocks against the wheels above them causes the chocks to tilt forward relative to the arms.

6. Positioning apparatus according to claim 1, in which said arms for the two chocks are located between the chocks, said apparatus including means rigidly connecting said arms, a common shaft rotatably mounted in the rear ends of the arms and extending outwardly therefrom, means rigidly mounting the chocks on the opposite ends of said shaft, a spring between the arms and connected at one end to the shaft, and means connecting the opposite end of the spring to said arms to maintain the upper surfaces of said chocks in the same position relative to the arms until the pressure of the front ends of the upwardly moving chocks against the wheels above them causes the chocks to tilt forward relative to the arms.

7. Positioning apparatus according to claim 1, in which said upper surface of each chock is engageable with a wheel above it at a contact point on said surface ciosest to said first-mentioned horizontal axis, and said pivotal means for the front end of said arm is located in such position that as said contact point is moved upwardly in engagement with the wheel the upwardly and forwardly swinging rear end of said arm will compel said contact point on the chock to substantially follow the cycloid curve described by the point on the wheel engaged by said contact point, whereby there will be substantially no slippage between the chock and wheel.

* * * * *